US009702258B2

(12) United States Patent
Mayer et al.

(10) Patent No.: US 9,702,258 B2
(45) Date of Patent: Jul. 11, 2017

(54) ADJUSTABLE TRANSITION SUPPORT AND METHOD OF USING THE SAME

(71) Applicant: Siemens Energy, Inc., Orlando, FL (US)

(72) Inventors: Clinton A. Mayer, Jupiter, FL (US); William M. Kieffer, Loxahatchee, FL (US); Paul G. Hicks, Jupiter, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 376 days.

(21) Appl. No.: 14/321,211

(22) Filed: Jul. 1, 2014

(65) Prior Publication Data

US 2016/0003069 A1 Jan. 7, 2016

(51) Int. Cl.
*F01D 9/02* (2006.01)
*F01D 25/28* (2006.01)

(52) U.S. Cl.
CPC ..... *F01D 9/023* (2013.01); *F01D 25/28* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,422,288 | A | 12/1983 | Steber | |
| 5,414,999 | A | 5/1995 | Barnes | |
| 7,377,117 | B2 | 5/2008 | Riggi, Jr. et al. | |
| 7,584,620 | B2 | 9/2009 | Weaver et al. | |
| 8,240,045 | B2 | 8/2012 | Sutcu et al. | |
| 8,322,146 | B2 * | 12/2012 | Rizkalla | F01D 9/023 60/752 |
| 8,448,450 | B2 | 5/2013 | LeBegue et al. | |
| 8,650,852 | B2 | 2/2014 | LeBegue et al. | |
| 8,701,415 | B2 | 4/2014 | Flanagan et al. | |
| 2006/0123797 | A1 * | 6/2006 | Zborovsky | F01D 9/041 60/800 |

* cited by examiner

*Primary Examiner* — David Walczak

(57) ABSTRACT

A gas turbine engine which has at least a combustor section and a turbine cylinder section, wherein the combustor section includes a transition piece coupled to a vane carrier assembly, wherein the vane carrier assembly includes a plurality of holes that correspond with one or more holes of the transition piece, and wherein at least one of the pluralities of holes is adapted to receive a pin-type member therein for shifting the transition piece toward an upstream or downstream end. A system and method for shifting a transition piece in a gas turbine engine includes at least moving a pin-type member from a first position to a second position, where the movement shifts the transition piece in a direction towards an upstream end or a downstream end.

20 Claims, 7 Drawing Sheets

ADJUSTABLE TRANSITION SUPPORT AND METHOD OF USING THE SAME

TECHNICAL FIELD

The present disclosure relates generally to gas turbine engines, and more particularly, to a gas turbine engine transition piece and its support assemblies.

BACKGROUND

Gas turbine engines operate to produce mechanical work or thrust. One type of gas turbine engine is a land based engine coupled to a generator for the purposes of generating electricity. Gas turbine engines have at least a compressor section, a combustor section, and a turbine section. The combustor section may include a plurality of combustors arranged in an annular array around a rotor. The turbine section includes alternating rows of stationary airfoils and rotating airfoils. In operation, air is drawn in through the compressor section, where it is compressed and the driven towards the combustor section. The air may then be mixed with fuel to form an air/fuel mixture. In the combustor, the mixture may be ignited to form a working gas. A transition duct may be provided for each combustor to route the working gas to the turbine section. Each transition duct includes an inlet (upstream) end, an exit (downstream) end. To support the transition duct in the gas turbine, fixed support assemblies including support brackets and various seals have been provided at the exit end of the transition duct to attach the same to a structure in the turbine section, like a vane carrier. However, concerns arise as these support assemblies suffer from large thermal stresses at various locations during the gas turbines operation. For example, cracks and indications may become present in the exit mounts of the support system. Therefore, there remains a need for a support system assembly that can minimize the above concerns.

SUMMARY

In one embodiment, a gas turbine with an adjustable transition assembly is described and which comprises a turbine housing with at least a combustor section operatively connected to a turbine cylinder section. The combustor section includes a transition duct having an upstream end and a downstream end, and a transition support coupled with the transition duct proximate to the downstream end. The transition support includes one or more recesses for coupling the transition support to a structure in a turbine section of a gas turbine and at least partially receiving a transition adjustable means therebetween. The turbine cylinder section includes a turbine support structure having a first and second surface. The first surface is coupled to the transition support through one or more recesses that may correspond to the recesses of the transition support. The second surface includes one or more recesses extending at least partially through a thickness of the turbine support structure, and is adapted to at least partially receiving a transition adjustable means therebetween. The gas turbine further includes a transition adjustable means disposed within the one or more recesses of the second surface, and extends at least partially through one or more recesses of the transition support structure for shifting the transition piece towards the upstream end or the downstream end.

In another embodiment, a system for adjusting a transition piece in a gas turbine is described. The system includes a transition assembly. The transition assembly includes a transition duct having an upstream end and a downstream end. The transition assembly further includes a transition support integrally formed with the transition duct proximate to the downstream end. The transition support may be formed from an aft mount with one or more holes and an exit frame with one or more holes. The transition support further comprises an outer surface for interfacing with a vane carrier assembly. The system further includes a vane carrier assembly at least partially interfacing with the transition support. The vane carrier assembly includes a plurality of holes corresponding to at least one or more holes of the transition support. The at least one of the plurality of holes is adapted to at least partially receive a means for adjusting a transition piece. Additionally, the system includes a transition adjustable means for adjusting a transition piece at least partially disposed between at least one of the plurality of holes of the vane carrier assembly for shifting the transition piece.

In yet a further embodiment, a method for shifting a transition piece in a gas turbine engine is disclosed. The method includes the step of moving a transition adjustable means in a gas turbine engine from a first position to a second position for shifting a transition piece towards an upstream end or a downstream end.

DETAILED DESCRIPTION

Figure 1:
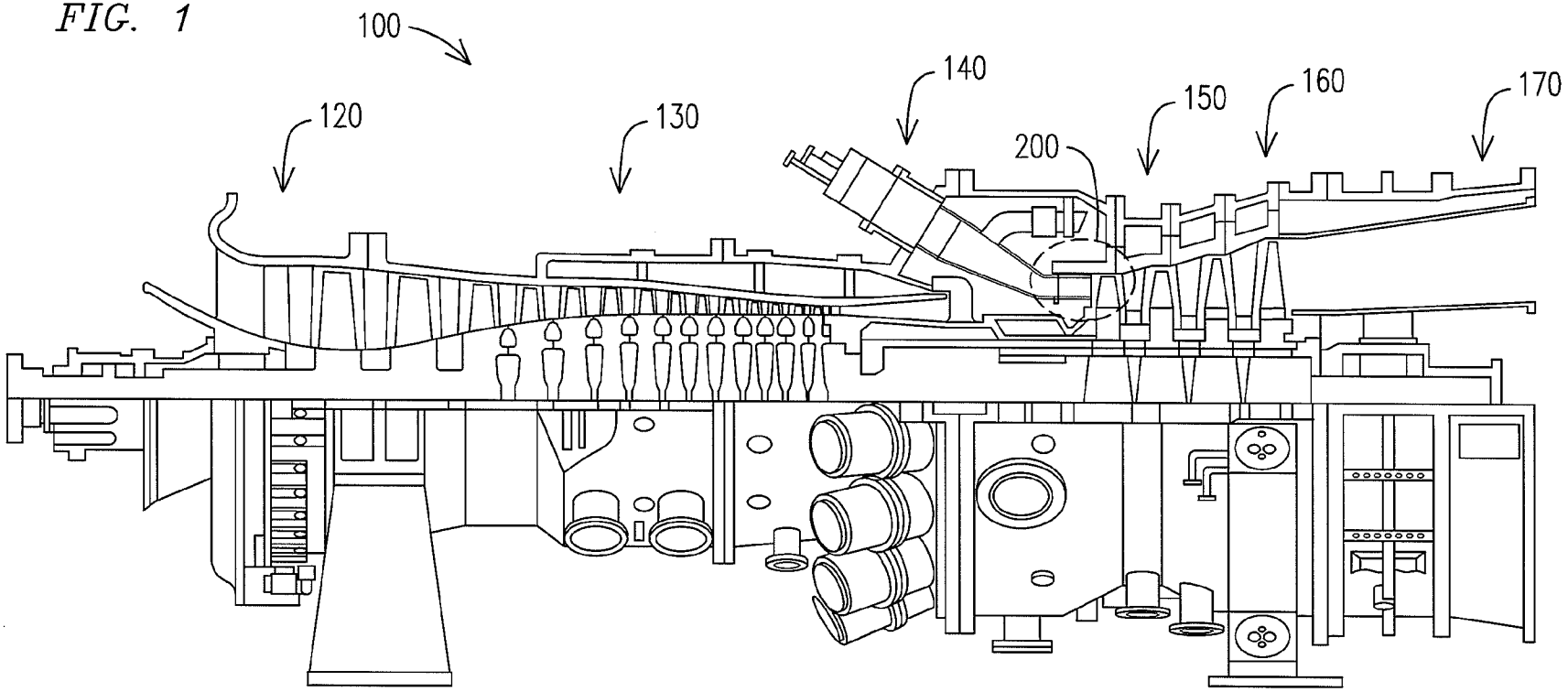
FIG. 1 is a cutaway perspective view of a gas turbine engine including an adjustable transition assembly.

Referring now to the drawings wherein the showings are for purposes of illustrating embodiments of the subject matter herein only and not for limiting the same, FIG. 1 shows a cutaway perspective view of a gas turbine engine (GTE) depicted generally at 100 with a transition assembly 200 including a transition adjustable means (not shown). The GTE 100 generally may include at least an inlet casing section 120 operatively connected to a compressor casing section 130; the compressor casing section 130 may be operatively connected to a combustor section 140; the combustor section 140 may be operatively connected to a turbine cylinder section 150; the turbine cylinder section 150 may be operatively connected to an exhaust cylinder section 160; the exhaust cylinder section 160 may be operatively connected to a manifold section 170.

Figure 2:
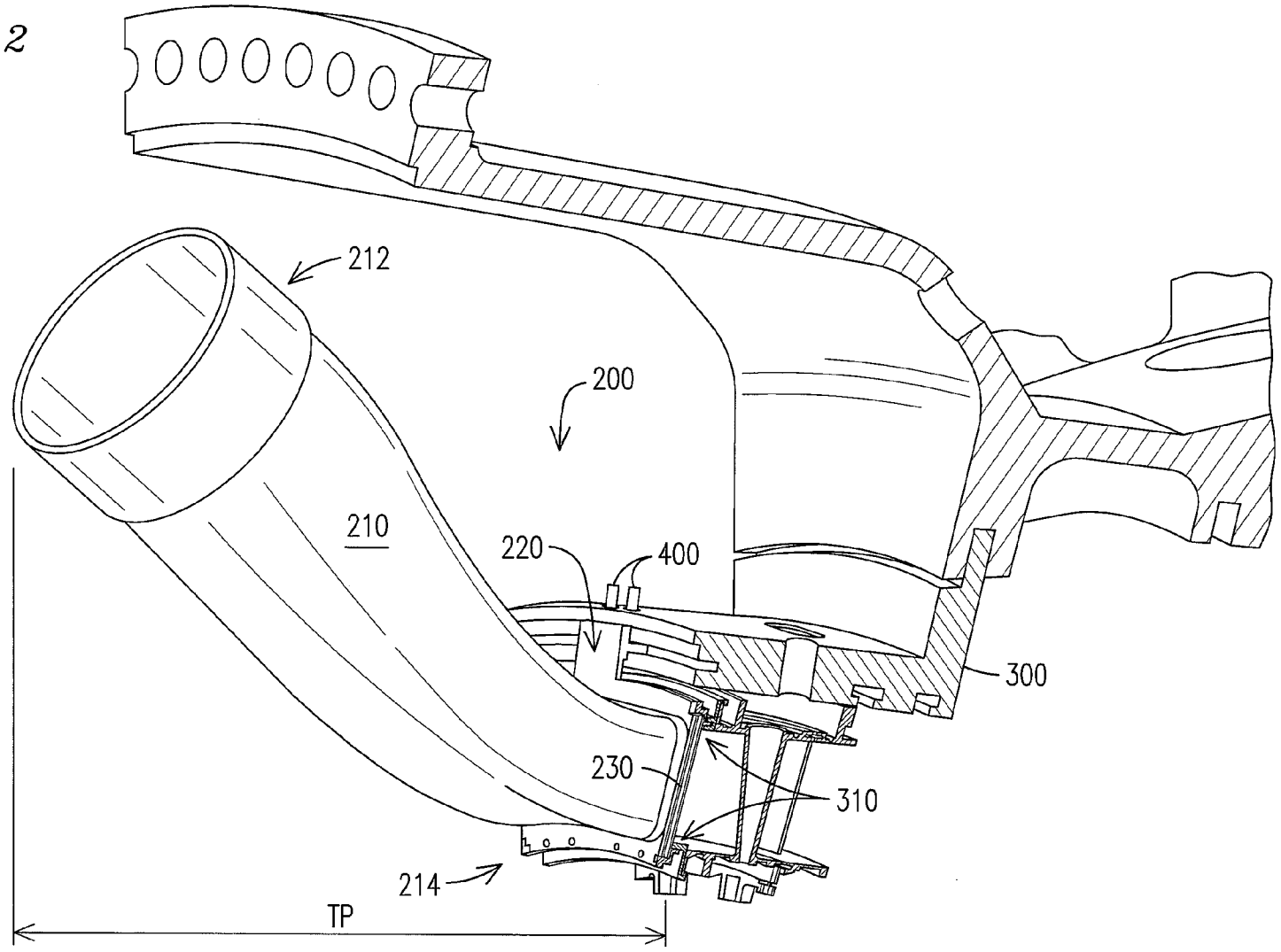
FIG. 2 is a perspective view of a gas turbine engine's combustor section and turbine cylinder section including an adjustable transition assembly.
Figure 3:
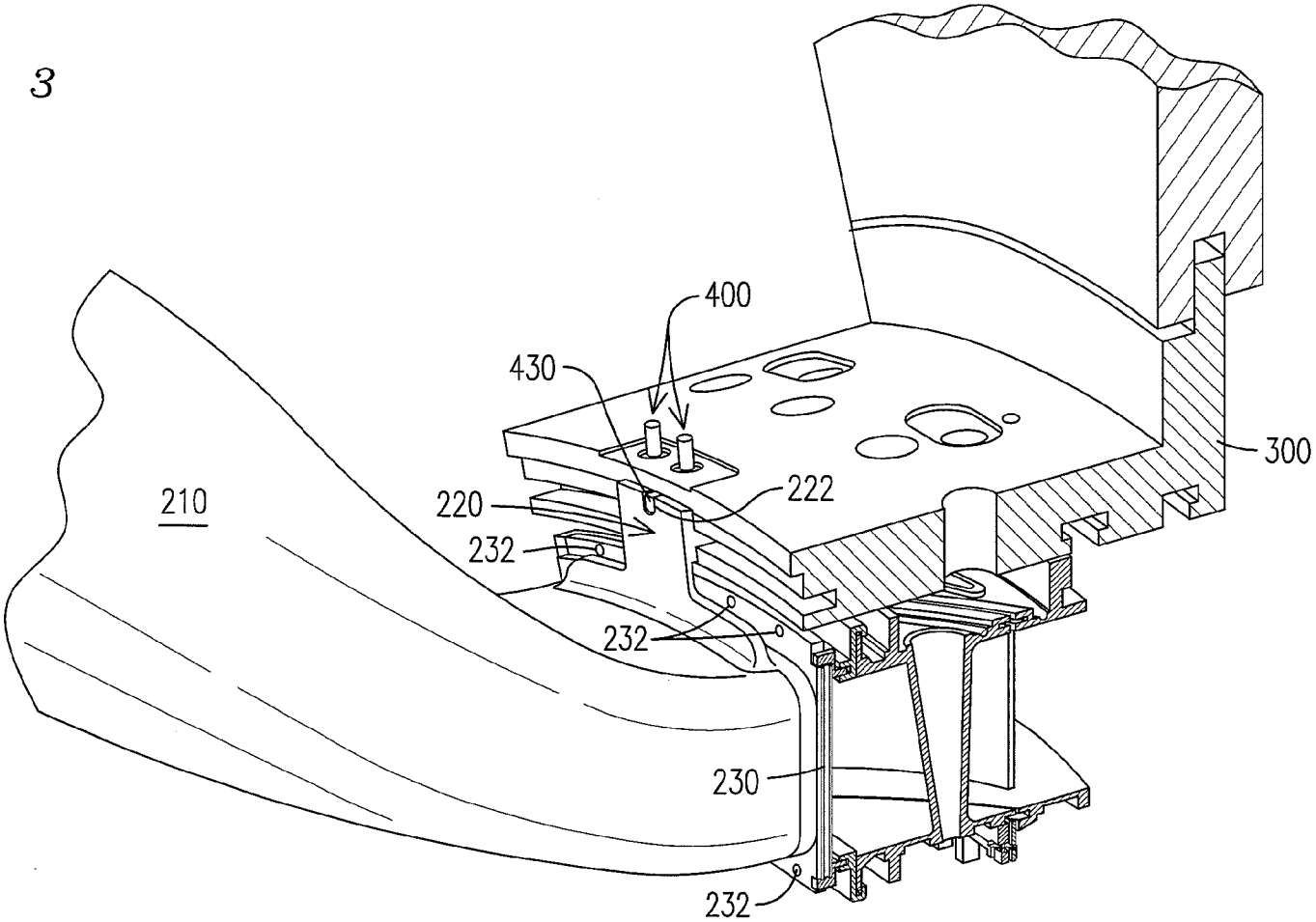
FIG. 3 is a second perspective view of a gas turbine engine's combustor section and turbine cylinder section including an adjustable transition assembly.

With reference to FIGS. 2-3, perspective views of an adjustable transition assembly 200 for removably securing a transition piece TP to a turbine vane carrier 300 in the GTE 100 are shown. In one embodiment, the transition assembly 200 may include a transition piece TP generally formed from a transition duct 210 and a transition support which may comprise or be formed from an aft mount 220 and exit frame 230, and a flange 240 (FIG. 4) protruding from one side of the aft mount 220. The transition duct 210 may have a generally tubular body with a generally semi-circular shape at an upstream end 212, to receive hot gases from an associated combustor of a gas turbine (e.g., a can-annular combustor), and a generally semi-rectangular shape at a downstream end 214, to discharge the gases to an associated stage of the gas turbine. The aft mount 220 may be integrally formed with the transition duct 210 and exit frame 230 proximate to the downstream end 214, in an arrangement sufficient to removably secure the transition piece TP to a structure in the turbine vane carrier 300. As used herein, integrally formed means to couple such that the pieces are relatively permanently joined. The transition duct 210, aft mount 220 and exit frame 230 may also be fabricated, molded or machined as a unitary structure, as compared to being separate components mounted together, through welding, fastening mechanical engagement or any means known to persons of ordinary skill in the art. The transition piece TP generally includes a plurality of recesses adapted to receive a fastening means (not shown) therein, e.g., bolts, fasteners, or pins, for securing the transition piece TP to the turbine vane carrier assembly 310. Additional examples of a fastening means may include a nut-bolt combination, rivet, screw, nail, or other suitable mechanical fastening devices known to persons of ordinary skill.

In the embodiment of FIG. 3, the transition piece TP is mounted to a turbine vane carrier assembly 310. The mounting may be accomplished by mechanical fastening or any means known to persons of ordinary skill in the art. The fastening means may include a thread portion corresponding to grooves of the recesses from which they are disposed in, or the recesses may be adapted such that the fastening means be frictionally fitted therein. The transition piece TP may include one or more recesses for securing the transition piece TP the vane carrier assembly 310 or other corresponding structure in a the turbine vane carrier 300. In the exemplary embodiment of FIG. 3, the transition piece TP includes one (1) recess 222 extending at least partially through the aft mount 220, and four (4) recesses 232 extending at least partially through the exit frame 230. It should be appreciated, however, that any number of recesses chosen with sound judgment and sufficient for securing the transition piece TP may be used. Mechanical fasteners (not shown) may then be disposed within the recesses 232 for securing the transition piece TP to the vane carrier assembly 310. Referring now FIGS. 4-7, in addition to the previous figures, at least a portion of the transition piece TP may include the flange 240 protruding from one side of the aft mount 220. The flange 240 may include one or more holes or recesses 242 extending at least partially through its thickness and adapted to receive a transition adjustable means 400 therein (FIG. 5). As will be discussed in detail below, adjusting the transition adjustable means 400 from a first position to a second position shifts the transition piece TP via shifting of the flange 240 toward the upstream end 212 or downstream end 214.

Figure 4:
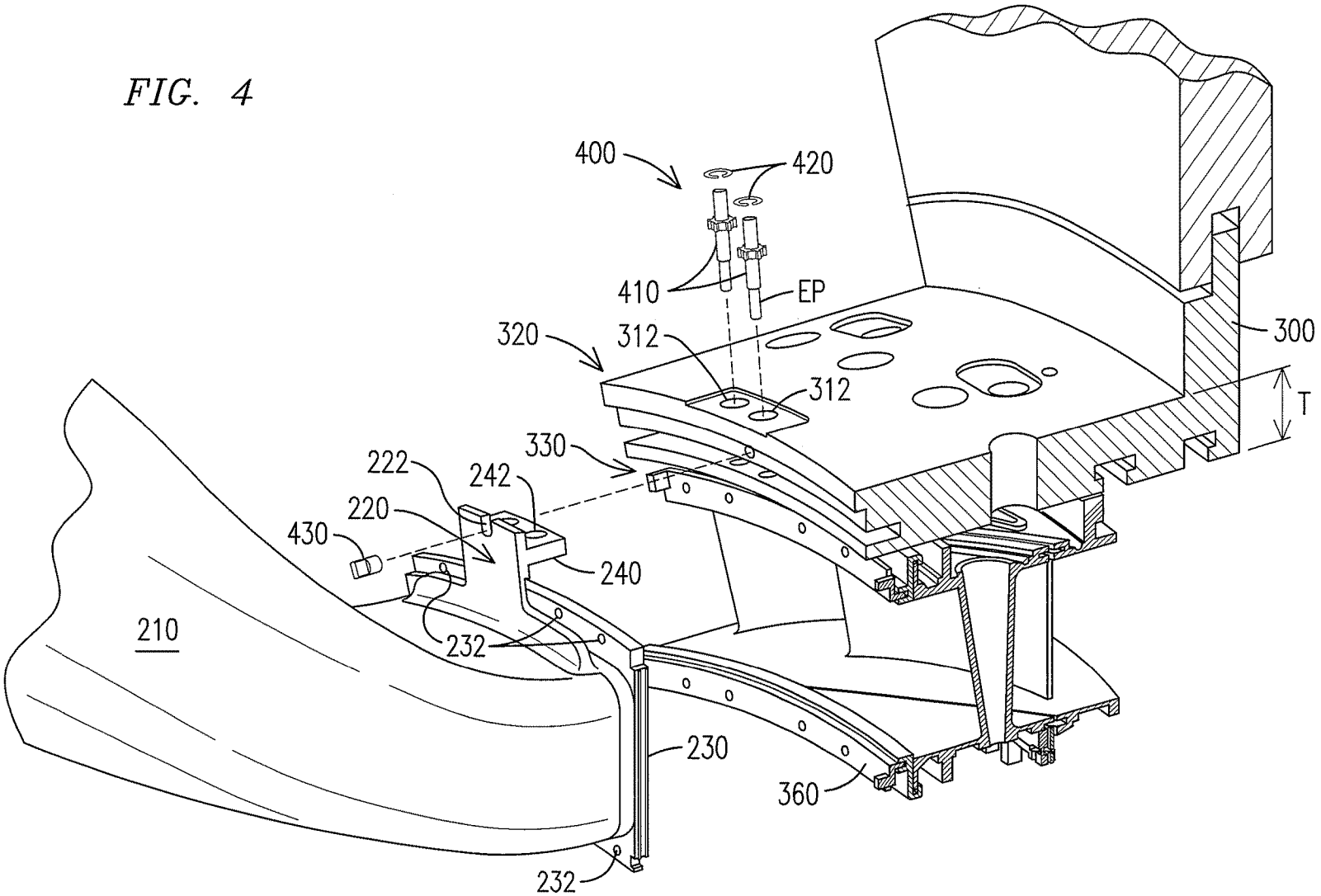
FIG. 4 is an exploded perspective view of the gas turbine engine's combustor section and turbine cylinder section of FIG. 3 including an adjustable transition assembly.
Figure 5:
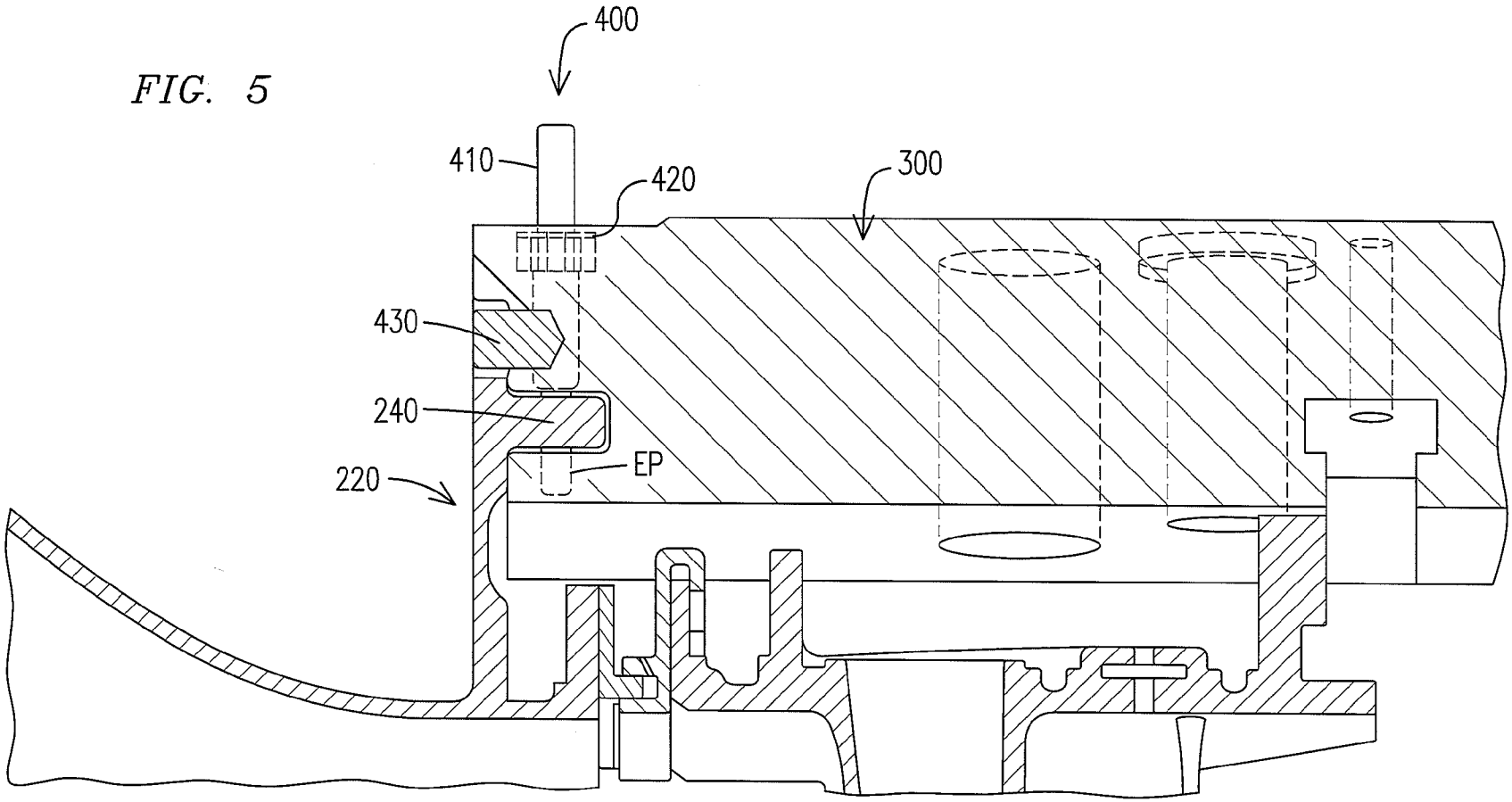
FIG. 5 is a side view of a gas turbine engine's combustor section and turbine cylinder section including an adjustable transition assembly
Figure 6:
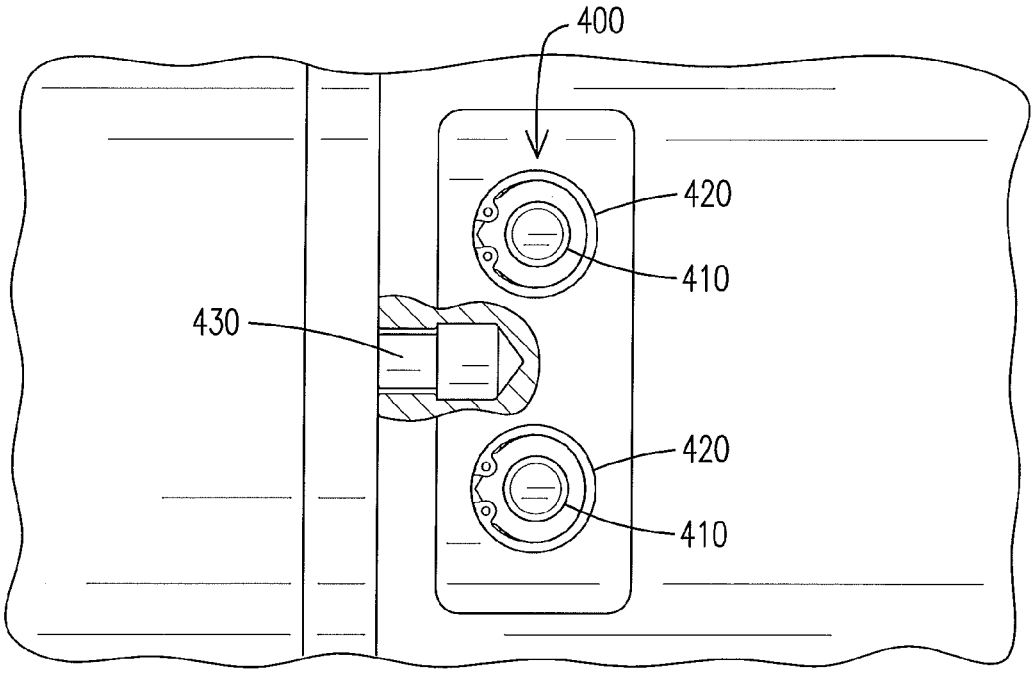
FIG. 6 is a top view of a gas turbine engine's combustor section and turbine cylinder section including an adjustable transition assembly.
Figure 7:
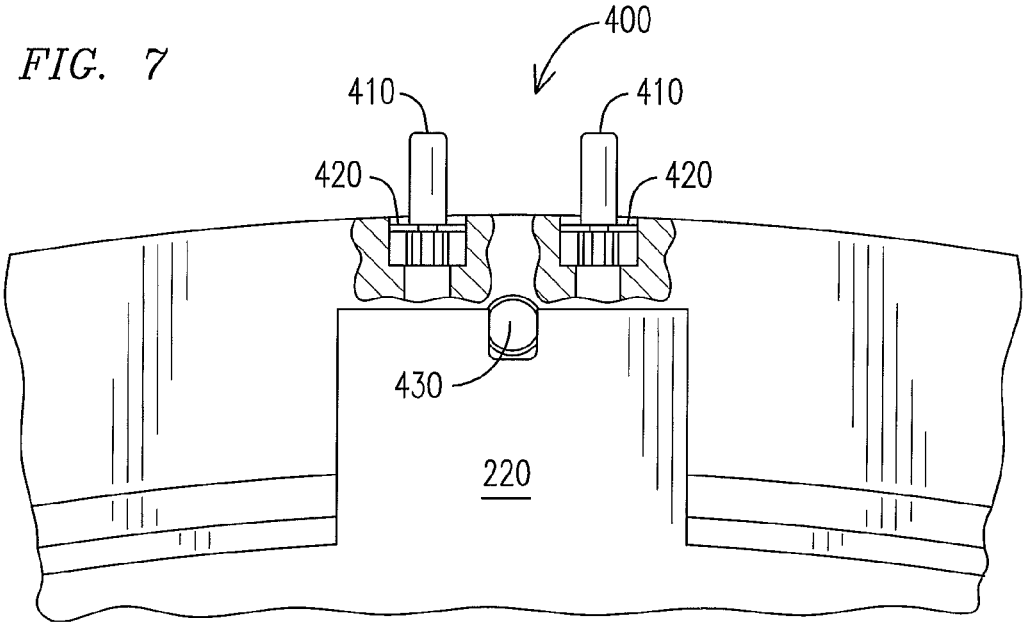
FIG. 7 is an elevation view of a gas turbine engine's combustor section and turbine cylinder section including an adjustable transition assembly.

With reference now to FIGS. 2-7, the turbine vane carrier assembly 310, in one embodiment, may be a continuous extension of the turbine vane carrier 300, i.e., the vane carrier assembly 310 and the turbine vane carrier 300 are a single construction with the section identified as the vane carrier assembly 310 being the portion of the turbine vane carrier 300 contoured to interface with the transition assembly 200 for coupling with the transition piece TP. In a further embodiment, the vane carrier assembly 310 may be formed from separate components integrally formed with the turbine vane carrier, or fabricated with the turbine vane carrier in a manner similar to the formation of the transition piece TP, or by any means known to person of ordinary skill. The vane carrier assembly 310 may include a plurality of recesses corresponding to the recesses of the transition piece TP for coupling the transition piece TP to the vane carrier assembly 310. Additionally, as shown in FIG. 4, the vane carrier assembly 310 may include a first side 320 and a second side 330 defining a thickness T therebetween. The first side 320 may include one or more recesses 312 extending at least partially through the thickness T and adapted to receive a transition adjustable means 400 therein. In one embodiment, the recess 312 extending through the thickness T may be offset from the recess 242 of the flange 240 for which the transition adjustable means 400 is disposed. In this embodiment, the offset recesses allow for the transition adjustable means 400 to be disposed within both recesses and allow for shifting of the transition piece TP from a first position to a second position. Offset, in this context, may be defined as not being in perfect alignment, but instead corresponding in a manner sufficient to allow for the transition adjustable means 400 to be received therein. As shown in FIG. 5, when the transition adjustable means 400 is disposed within the recesses 312, the transition adjustable means 400 extends through the thickness T such that at least a portion of the transition adjustable means 400 is received within the recess 242 of the flange 240, which may be the offset recess.

With reference to FIGS. 4-5 the transition adjustable means 400 may be a pin-type member 410 disposed within the one or more recesses of the vane carrier assembly 310 and flange 240, and adapted to engage at least a portion of the interior surface of the recess it is disposed in. The pin-type member 410 may be a single piece construction, or formed from multiple pieces integrally formed or fabricated through welding, machining or any means known to persons of ordinary skill in the art. The pin-type member 410 may have a cylindrical eccentric portion EP (FIG. 5) adapted to be disposed within the recess 242 of the flange 240 by way of the recess 312, which may be offset from the recess 242. The eccentric portion EP may have a diameter less than the non-eccentric portion, and not have its axis placed centrally. In operation, moving (e.g., rotating, depressing) the pin-type member 410 from a first position to a second position shifts the transition piece towards either the upstream end 212 or downstream end 214.

In another embodiment, the pin-type member 410 may include an anti-rotation means for preventing movement of the pin-type member 410. The anti-rotation means may be one or more serrations on at least a portion of the pin-type member 410 to prevent rotation of the pin-type member 410 due to vibrations and/or dynamic loading. In this embodiment, the case of the turbine vane carrier 300 may include one or more recesses adapted for interfacing/mating with the one or more serrations of the pin-type member 410. Other anti-rotation means (e.g., clamps, retainers etc.) known to persons of ordinary skill and chosen with sound judgment may also be used alone or in combination with the above described serrations for preventing movement of the pin-type member 410. The serrations may be included proximate to the upper portion of the pin-type member 410, e.g., a flange portion of the pin-type member 410. The anti-rotation means may further assist to maintain the intended axial offset of the exit frame 230 from the downstream vane.

In a further embodiment, the transition adjustable means 400 may also include a retaining means 420 for removably securing the pin-type member 400. In one embodiment, the retaining means 420 may be a snap ring, which may be disposed in the recess following the disposal or insertion of the pin-type member 410. In yet another embodiment, the transition adjustable means 400 may also include a second pin-type member disposable within the recess 222 for constraining the transition piece TP in the circumferential direction relative to the turbine vane carrier 300. With continued reference to FIGS. 2-5, and now FIG. 6, the second pin-type member may be a constraint pin 430 disposed within the recess 222 of the aft mount 220. The constraint pin 430 may extend axially at least partially through the thickness of the vane carrier assembly to facilitate proper clocking of the exit frame 230 relative to the turbine vane carrier 300, which in turn may serve as a grounding mechanism for the aft mount 220.

In a further embodiment, the constraint pin 430 may be hard mounted to the turbine vane carrier 300. The transition piece TP may then be brought in axially to engage the axial flange 240 to corresponding recesses in the turbine vane carrier 300. The recess 222 of the aft mount 220 may engage the circumferential constraint pin 430 mounted to the turbine vane carrier 300. The pin-type member 410 may then be inserted through the recess 312 of the turbine vane carrier 300 until the pin-type member 410 is in proximity to or engages the recess 242 of the flange 240. Measurements may then be taken between the aft face of the exit frame 230 and the vane carrier assembly 310 to determine the necessary adjustment for the transition piece TP for minimizing and/or eliminating the loss of resources (e.g., gases) flowing through the transition piece TP. Measurement distances may be generally between 0.01 mm and 4.0 mm. In one embodiment, loss of resources was minimized/eliminated with distances between 0.1 mm and 3.0 mm, or more particularly, distances between 2.0 mm and 2.5 mm.

In a further embodiment, at least a portion of the pin-type member 410 may be adapted to interface with an adjustment tool to allow for adjustment of the pin-type member 410 from a first position to a second position. The adapted to interface portion may be an upper portion of the pin-type member 410 which may include a threaded recess fabricated into the upper portion of the pin-type member 410. The threaded portion may have a diameter smaller than the diameter of the upper portion of the pin-type member 410. In yet a further embodiment for interfacing with the adjustment tool, the outer surface of an exposed portion of the pin-type member 410 may be adapted such that the exposed portion may be mated and/or frictionally engaged with the adjusting tool for facilitating the adjustment of the pin-type member 410. In this embodiment the exposed portion may be grooved, textured, threaded, or have any configuration, chosen with sound judgment to allow for the movement of the pin-type member 410.

In yet a further embodiment, the pin-type member 410 may include a generally cylindrical body having a cavity for housing a biasing mechanism, e.g., compression spring and/or actuator therein. In this embodiment, the biasing mechanism may be positioned in the pin-type member 410 such that compressing or depressing of a portion of the pin-type member 410 shifts the transition piece towards to the upstream end 212 or the downstream end 214.

With reference to FIGS. 2-5, the vane carrier assembly 310 may also include one or more seals 360 disposed between the vane carrier assembly 310 and an transition piece to dampen vibrations that may occur during the operation of the GTE 100, and/or to minimize the migration of compressed air from the combustor section 140 to the turbine section 150 through any space between the outer surface of the transition piece TP and the interfacing portion of the vane carrier assembly 310. The seals 360 may be any suitable seals known to persons of ordinary skill in the art, e.g., a rope seal or spring leaf seal. The seals 360 may be a continuous piece or any number of pieces in an abutting relation.

Figure 8:
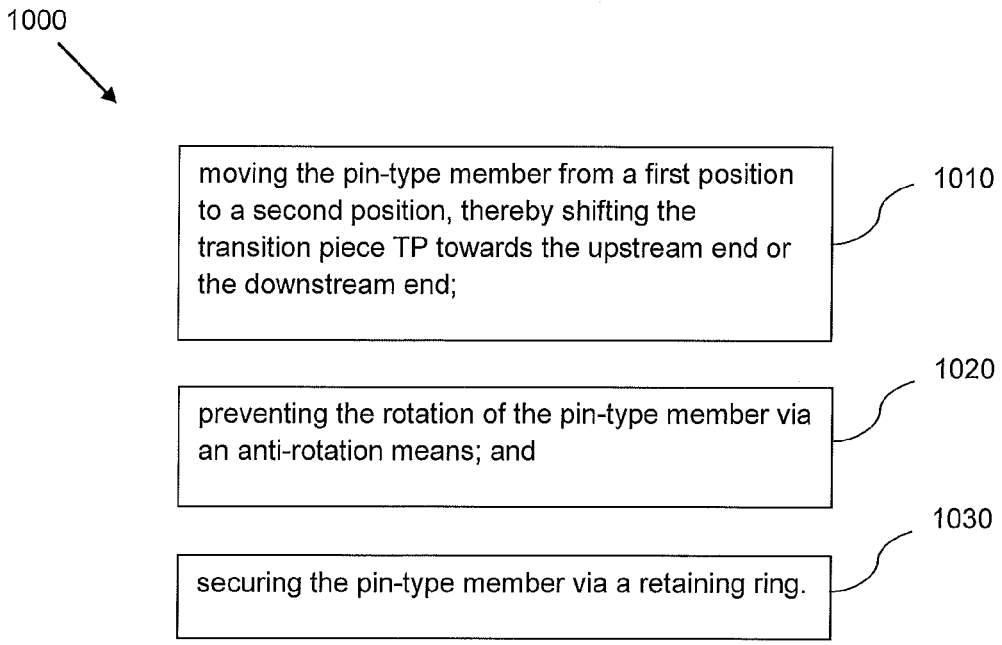
FIG. 8 is a block diagram of a method for adjusting the spacing between a gas turbine engine's transition piece and vane carrier assembly.

With reference to FIG. 8, a block diagram of a method 1000 for moving a transition piece TP of a gas turbine engine is exemplified. In step 1010, moving the pin-type member 430 from a first position to a second position until the axial measurement between the exit frame 230 and the vane carrier assembly 310 meets installation requirements. In this step, the transition piece TP is shifted towards the upstream end 212 or the downstream end 214. In step 1020, securing the pin-type member 410 via the anti-rotation means (described above). In step the pin-type member 410 is prevented from further movement once the desired distance is accomplished. In step 1030, securing the pin-type member 410 via the retaining ring 420.

While specific embodiments have been described in detail, those with ordinary skill in the art will appreciate that various modifications and alternative to those details could be developed in light of the overall teachings of the disclosure. For example, elements described in association with different embodiments may be combined. Accordingly, the particular arrangements disclosed are meant to be illustrative only and should not be construed as limiting the scope of the claims or disclosure, which are to be given the full breadth of the appended claims, and any and all equivalents thereof. It should be noted that the term "comprising" does not exclude other elements or steps and the use of articles "a" or "an" does not exclude a plurality.

We claim:

1. A gas turbine with an adjustable transition piece comprising:

at least a combustor section operatively connected to a turbine section;

wherein said combustor section includes:

a transition duct having an upstream end and a downstream end; and a transition support coupled with said transition duct proximate to said downstream end, said transition support having a plurality of recesses for coupling said transition support to the turbine section; and wherein said turbine section includes:

a vane carrier assembly, and wherein said vane carrier assembly is coupled to said transition support via a transition adjustable means disposed between one or more recesses of the vane carrier assembly corresponding to one or more of the plurality of recesses of said transition support for shifting said transition duct towards said upstream end or said downstream end.

2. The gas turbine of claim 1, wherein said transition adjustable means is a pin.

3. The gas turbine of claim 2, wherein said transition adjustable means is an eccentric pin.

4. The gas turbine of claim 3, wherein at least a portion of said eccentric pin is threaded.

5. The gas turbine of claim 1, wherein said transition adjustable means shifts said transition support integrally formed with said transition duct towards said upstream end.

6. The gas turbine of claim 1, wherein said transition adjustable means shifts said transition support integrally formed with said transition duct towards said downstream end.

7. A system for adjusting a transition piece in a gas turbine comprising:

a transition piece including:

a transition duct having an upstream end for operatively connecting to a combustor section of a turbine, and a downstream end for operatively connecting to a turbine cylinder section of a turbine; and a transition support integrally formed with said transition duct proximate to said downstream end, said transition support formed from an aft mount including a flange having one or more holes, and an exit frame;

a vane carrier assembly at least partially interfacing with said transition support, said vane carrier assembly having a plurality of holes corresponding to the one or more holes of said flange; and a means for adjusting a transition piece at least partially received within the one or more of said plurality of holes of said vane carrier assembly and the corresponding one or more holes of the flange for shifting said transition piece.

8. The system of claim 7, wherein the means for adjusting a transition piece is a pin.

9. The system of claim 8, wherein the means for adjusting a transition piece is an eccentric pin.

10. The system of claim 9, wherein at least a portion of said eccentric pin is threaded, and at least one of said holes receiving said eccentric pins includes grooves corresponding to the treaded portion.

11. The system of claim 10, wherein the means for adjust a transition piece further includes a retaining means for removably securing said eccentric pin.

12. The system of claim 11, wherein the retaining means is a snap ring.

13. The system of claim 7, wherein means for adjusting a transition piece is configured to shift said transition piece toward said upstream end or said downstream end.

14. An adjustable transition piece comprising:

a transition duct having an upstream end and a downstream end;

a transition support proximate to said downstream end and including a flange adapted to interface with a vane carrier at the downstream end and including a radially extending hole positioned relative to a corresponding radially extending hole of the vane carrier when the flange interfaces with the vane carrier; and a means for adjusting a transition piece adapted to be at least partially received through the radially extending holes of the vane carrier and flange for shifting the transition piece in an upstream or downstream direction based on a movement of the means for adjusting a transition piece.

15. The transition piece of claim 14, wherein the transition support is integrally formed with the transition duct.

16. The transition piece of claim 14, wherein the means for adjusting the transition piece is a pin.

17. The transition piece of claim 16, wherein the pin is an rotatable eccentric pin.

18. The transition piece of claim 16, further comprising a retaining means adapted to interface with the pin to restrict movement of the pin.

19. The transition piece of claim 14, wherein at least a portion of the means for adjusting a transition piece is threaded and at least one of the radially extending holes of the vane carrier and flange includes grooves corresponding to the treaded portion of the means for adjusting a transition piece.

20. The transition piece of claim 14, wherein at least a portion of the means for adjusting a transition piece includes an anti-rotation means.

* * * * *